US005128229A

United States Patent [19]

Katsukawa et al.

[11] Patent Number: 5,128,229

[45] Date of Patent: Jul. 7, 1992

[54] ELECTROPHOTOSENSITIVE MATERIAL AND METHOD OF MANUFACTURING THE SAME

[75] Inventors: Masato Katsukawa, Ibaraki; Keizo Kimoto, Hirakata; Mitsuji Tsujita, Osaka; Satoru Miura, Shijonawate, all of Japan

[73] Assignee: Mita Industrial Co., Ltd., Osaka, Japan

[21] Appl. No.: 585,669

[22] Filed: Sep. 20, 1990

[30] Foreign Application Priority Data

| | | | |
|---|---|---|---|
| Sep. 27, 1989 | [JP] | Japan | 1-251585 |
| Sep. 27, 1989 | [JP] | Japan | 1-251586 |
| Sep. 27, 1989 | [JP] | Japan | 1-251587 |
| Sep. 27, 1989 | [JP] | Japan | 1-251588 |
| Sep. 27, 1989 | [JP] | Japan | 1-251589 |

[51] Int. Cl.[5] ..... G03G 5/09; G03G 5/087

[52] U.S. Cl. ..... 430/83; 430/59; 430/96; 430/130

[58] Field of Search ..... 430/96, 58, 59, 130, 430/83

[56] References Cited

U.S. PATENT DOCUMENTS

| | | | |
|---|---|---|---|
| 4,495,261 | 1/1985 | Takahashi et al. | 430/58 |
| 4,663,259 | 5/1987 | Fujimura et al. | 430/58 |

*Primary Examiner*—Roland Martin

*Attorney, Agent, or Firm*—Beveridge, DeGrandi & Weilacher

[57] ABSTRACT

The electrophotosensitive material in accordance with the present invention containing a layer which contains polycarbonate as a binding resin and of which glass transition temperature is not lower than 62° C. This layer is excellent in adhesion to the foundation. This layer may be a photosensitive layer containing a m-phenylenediamine compound as a charge transferring material, or a photosensitive layer containing a m-phenylenediamine compound and a perylene compound as a charge generating material. The present invention also provides a photosensitive layer of which the amount of residual tetrahydrofuran is adjusted to a predetermined value or less, thereby to prevent the photosensitive layer from being decreased in sensitivity due to ultraviolet rays or visible ray.

7 Claims, 2 Drawing Sheets

ELECTROPHOTOSENSITIVE MATERIAL AND METHOD OF MANUFACTURING THE SAME

BACKGROUND OF THE INVENTION

The present invention relates to an electrophotosensitive material used in an image forming apparatus such as a copying machine.

In a recent, image forming apparatus using a so-called Carlson Process, there has been often used, in view of easiness of improvement in sensitivity, a so-called function-separated type photosensitive material in which the charge generating function and the charge transferring function are respectively achieved, as separated from each other, by a charge generating material for generating an electric charge by light irradiation and a charge transferring material for transferring a generated charge. As examples of the function-separated type photosensitive material above-mentioned, there are available (i) a multilayer type photosensitive material in which a multilayer type photosensitive layer unit having a charge generating layer containing the charge generating material and a charge transferring layer containing the charge transferring material, is formed on the surface of a conductive substrate, and (ii) a single-layer type photosensitive material in which a single-layer type photosensitive layer containing both the charge generating material and the charge transferring material, is formed on the surface of a conductive substrate.

Examples of the function-separated type photosensitive material above-mentioned, include (i) an organic photosensitive material in which the entire single-layer type or multilayer type photosensitive layer formed on the surface of the conductive substrate, is an organic layer containing, in a binding resin, functional components such as the charge generating material, the charge transferring material and the like; and (ii) a composite-type photosensitive material in which a portion of the multilayer type photosensitive layer unit is an organic layer. These photosensitive materials above-mentioned are suitably used since they have a variety of choices for materials to be used and present good productivity and high degree of freedom for function designing.

As the binding resin forming the respective organic layers, a variety of synthetic resin materials are used, and polycarbonate excellent in physical properties such as mechanical strength and the like is particularly preferred.

However, the polycarbonate is poor in adhesive properties to the foundation, particularly the surface of the conductive substrate or the like. This presents the problem that the polycarbonate is easily separated while images are continuously formed.

There is the likelihood that the organic photosensitive layer in the organic photosensitive material or the composite-type phtosensitive material becomes fatigued to decrease the charge amount, sensitivity and the like when an image forming process of charging, light exposure, charge eliminating and the like is repeated. To prevent such a problem, there has been recently proposed a photosensitive material in which, in addition to a normal charge transferring material, other charge transferring material of a m-phenylenediamine compound excellent in properties for preventing a decrease in charge amount, sensitivity and the like, is being contained in polycarbonate. There has also been proposed a single-layer type photosensitive material in which polycarbonate contains a m-phenylenediamine compound as the charge transferring material and a perylene compound as the charge generating material.

However, the photosensitive material containing the m-phenylenediamine compound presents the problem of decrease in sensitivity when the photosensitive material is irradiated by light from a fluorescent lamp, a xenon lamp, the sun or the like, particularly at the time when the photosensitive material is heated (usually about 60° C.), for example, during the operation of the image forming apapratus or the like.

On the other hand, when the single-layer type photosensitive material containing both the m-phenylenediamine compound and the perylene compound is irradiated by light from a halogen lamp, the sun or the like while the photosensitive material is under heating, the sensitivity of the photosensitive material is decreased by visible ray contained in the light above-mentioned.

SUMMARY OF THE INVENTION

It is a main object of the present invention to provide an electrophotosensitive material having a layer which contains polycarbonate as a binding resin and which is excellent in physical properties such as mechanical strength and the like and also excellent in adhesion to the foundation, and also to provide a method of manufacturing such an electrophotosensitive material.

It is another object of the present invention to provide an electrophotosensitive material which is excellent in properties to prevent a decrease in charge amount and sensitivity at the time when an image forming process is repeated, and of which sensitivity is hardly decreased (deteriorated) due to irradiation of ultraviolet rays, and also to provide a method of manufacturing such an electrophotosensitive material.

It is a further object of the present invention to provide an electrophotosensitive material which is excellent in properties to prevent a decrease in charge amount and sensitivity at the time when an image forming process is repeated, and of which sensitivity is hardly decreased (deteriorated) due to irradiation of visible ray, and also to provide a method of manufacturing such an electrophotosensitive material.

The inventors have studied hard in order to eliminate the problem that the layer containing polycarbonate is separated from the foundation at the time when images are continuously formed. Then, the inventors have found the novel fact that, because the glass transition temperature of this layer is lower than the heating temperature (about 60° C.) of the electrophotosensitive material at the image forming time, the layer is separated due to great difference in physical properties such as coefficient of thermal expansion and the like between this layer and the foundation when the electrophotosensitive material is heated.

Based on this novel fact, the inventors have completed the electrophotosensitive material of the present invention in which the layer containing polycarbonate as the binding resin has a glass transition temperature of not lower than 62° C.

According to the present invention, the glass transition temperature of this layer is higher than the heating temperature of the electrophotosensitive material. This produces no great difference in physical properties between this layer and the foundation in use, thus enhancing the adhesion of the layer to the foundation.

The polycarbonate includes a variety of types according to the types of bisphenol used as the raw material thereof. However, polycarbonate of the bis-phenol-Z type represented by the following general formula [I], i.e., poly-(4,4'-cyclohexylidenediphenyl)carbonate, is more preferably used in view of its excellent applicability as a coating solution and excellent physical properties of a resultant film.

(I)

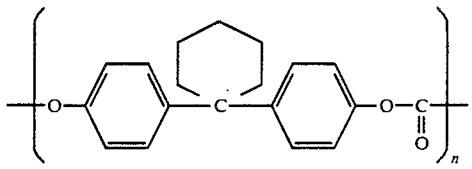

The fact that the layer containing a m-phenylenediamine compound in polycarbonate is decreased in sensitivity when exposed to ultraviolet rays, has been considered to be caused by the following reason. That is, the m-phenylenediamine compound is excited by the ultraviolet absorption by the compound itself or an energy transmitted from an ultraviolet absorbing substance such as the charge generating material or the like. This produces a dimerization or decomposition reaction, causing the compound to be changed to a substance acting as a carrier trap to decrease the sensitivity of the photosensitive material.

Then, the inventors have supposed that, when the glass transition temperature of the layer mainly comprising polycarbonate is lower than the heating temperature (60° C.) of the photosensitive material in use, the layer is changed to glass so that the polycarbonate forming this layer is brought to a state where the excited energy is readily transmitted to the m-phenylenediamine compound, thus accelerating the dimerization or decomposition reaction of the m-phenylenediamine compound. Based on this supposition, the inventors have investigated the relationship between the glass transition temperature of the layer containing the m-phenylenediamine compound in polycarbonate and a decrease in sensitivity due to ultraviolet rays. Further, when the layer is heated to a temperature higher than the glass transition temperature thereof, the difference in physical properties such as coefficient of thermal expansion and the like between the layer and the foundation becomes great to lower the adhesion of the layer to the foundation. This lowers the conductivity between the layer and the foundation. This is also considered to be one of causes of the decrease in sensitivity.

As the result, the inventors have found that, when the glass transition temperature of the layer containing polycarbonate is not lower than 62° C., there is no possibility of the layer, even heated, being changed to glass, so that an image presenting no practical problems may be obtained.

Thus, the present invention includes an electrophotosensitive material having a layer containing, in polycarbonate as the binding resin, the m-phenylenediamine compound as the charge transferring material, this layer presenting a glass transition temperature of not lower than 62° C.

Further, in a single-layer type photosensitive material containing, in polycarbonate, the m-phenylenediamine compound and the perylene compound, the visible ray absorption by the m-phenylenediamine compound itself or the transmission of an excited energy from the perylene compound as a visible ray absorbing substance, produces a dimerization or decomposition reaction of the m-phenylenediamine compound, thereby to decrease the sensitivity of the photosensitive material. It is found that such a decrease in sensitivity due to visible ray may be prevented when the glass transition temperature of the layer is raised to 62° C. or more, likewise in the foregoing.

Thus, the present invention also includes an electrophotosensitive material having layers respectively containing, in polycarbonate as the binding resin, the m-phenylenediamine compound as the charge transferring material and the perylene compound as the charge generating material, the glass transition temperatures of the layers being not lower than 62° C.

To raise the glass transition temperature of the layer containing polycarbonate as the binding resin, this layer may be thermally treated at a temperature of 110° C. or more for 30 minutes or more. The glass transition temperature of the layer containing the m-phenylenediamine compound alone or together with the perylene compound, may also be raised to 62° C. or more by thermally treating this layer in a manner similar to that above-mentioned.

The decrease in sensitivity due to ultraviolet rays of the layer containing the m-phenylenediamine compound in the binding resin also occurs when this layer is formed from a coating solution using tetrahydrofuran (hereinafter referred to as THF) which is often used as a solvent or a dispersion medium. Such decrease is considered to be caused by the fact that residual THF in the layer acts as an ultraviolet absorbing substance and participates in a dimerization or decomposition reaction of the m-phenylenediamine compound. In this connection, the inventors have also investigated the relationship between the amount of residual THF in the formed layer and the decrease in sensitivity, and found the novel fact that, when the amount of residual THF is not greater than $2.5\times10^{-3}$ μl/mg, the deterioration in sensitivity is prevented so that an image presenting no practical problem may be obtained.

Thus, the electrophotosensitive material in accordance with the present invention also includes an electrophotosensitive material having a layer formed by applying a coating solution containing the binding resin, the m-phenylenediamine compound as the charge transferring material and THF, the amount of residual THF in the layer being not greater than $2.5\times10^{-3}$ μl/mg.

In the single-layer type photosensitive material containing the m-phenylenediamine compound and the perylene compound in the binding resin, the residual THF in the layer serves as a visible ray absorbing substance likewise the perylene compound. Accordingly, when the amount of residual THF in the layer is adjusted to a range identical with that above-mentioned, the deterioration in sensitivity due to visible ray may be effectively prevented. Thus, the present invention also includes an electrophotosensitive material having a layer formed by applying a coating solution containing the binding resin, the m-phenylenediamine compound as the charge transferring material, the perylene compound as the charge generating material and THF, the amount of residual THF in the layer being not greater than $2.5\times10^{-3}$ μl/mg.

To adjust the amount of residual THF in the layer to not greater than $2.5\times10^{-3}$ μl/mg, it is enough to thermally treat, at a temperature of 110° C. or more for 30 minutes or more, the layer formed by applying a coating solution containing the binding resin, the m-phenylenediamine compound as the charge transferring material and THF. The layer formed from a coating solution containing the m-phenylenediamine compound and the perylene compound, may also be thermally treated under conditions similar to those above-mentioned.

DETAILED DESCRIPTION OF THE INVENTION

Figure 1:
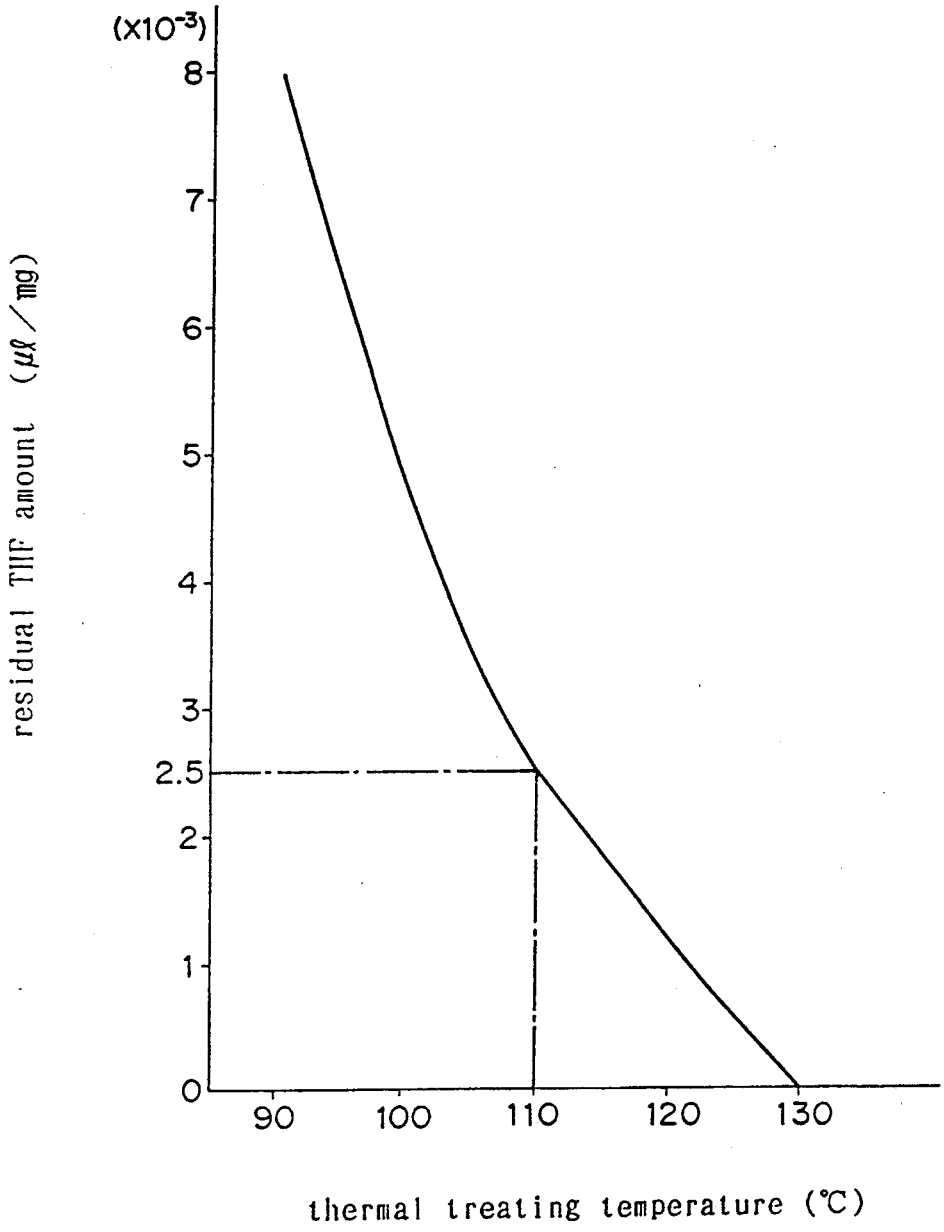
FIG. 1 is a graph showing the relationship between thermal treating temperature and residual THF amount of a single-layer type photosensitive layer.

The present invention may be applied to various types of electrophotosensitive materials each having an organic layer containing polycarbonate as the binding resin, and preferably applied to each of the following layers formed directly on a surface made of a different material such as metal or the like:

(i) a single-layer type organic photosensitive layer containing, in the binding resin, the charge generating material and the charge transferring material and formed on the surface of a conductive substrate;

(ii) the lower layer of a multilayer type organic photosensitive layer unit in which an organic charge generating layer and an organic charge transferring layer are being laminated on the surface of a conductive substrate, said lower layer coming in contact with the surface of the conductive substrate; and (iii) an organic charge transferring layer of a composite type photosensitive layer unit in which the organic charge transferring layer is being laminated on a charge generating layer in the form of a thin film made of a semiconductor material.

To improve the adhesion of the layer containing polycarbonate to the foundation, the glass transition temperature of the layer should be raised to 62° C. or more. Particularly, when the glass transition temperature of a photosensitive layer containing the m-phenylenediamine compound as the charge transferring material, is lower than 62° C., an excessive amount of an excited energy is transmitted to the m-phenylenediamine compound at the time of light irradiation. This produces a dimerization or decomposition reaction of a great amount of the m-phenylenediamine compound. As the result, the deteriorated portion of the photosensitive layer is considerably decreased in sensitivity. Particularly in a halftone image (grey image), a portion thereof corresponding to the deteriorated portion above-mentioned becomes darkened, resulting in lack of uniformity. It is therefore not possible to obtain an image of practical use.

To raise the glass transition temperature to 62° C. or more, there may be proposed a variety of methods such as blending of resin of which glass transition temperature is high, or the like. However, there is suitably employed a method of thermally treating the polycarbonate-containing layer to enhance the crystallizability of polycarbonate in this layer, thereby to raise the glass transition temperature thereof. According to this method, the layer is merely heated, requiring no large-scale apparatus or the like and the electrophotosensitive material of the present invention may be readily manufactured.

No particular restrictions are imposed on the thermal treating conditions, but the thermal treating temperature is preferably not lower than 110° C. and the thermal treating period of time is preferably not less than 30 minutes. When the thermal treating temperature is lower than 110° C. or the thermal treating period of time is less than 30 minutes, the crystallizability of polycarbonate in the layer cannot be sufficiently enhanced. To prevent the sublimation, decomposition or the like of the functional components contained in the layer such as the charge generating material, the charge generating material or the like, the thermal treating temperature is preferably not higher than 130° C.

When forming a specific layer by applying a coating solution containing polycarbonate to the surface of the foundation, the thermal treatment under the conditions above-mentioned may be carried out at the same time when the layer is dried, or may be applied to the layer which has been already dried and solidified.

As polycarbonate to be contained in the layer, there may be used bisphenol-Z type polycarbonate [I] excellent in mechanical strength. Other binding resin may be jointly used in such an amount as not to exert an influence upon the glass transition temperature of the layer. Examples of other binding resin include: other polycarbonate such as bisphenol-A type polycarbonate than the bisphenol-Z type polycarbonate; thermosetting silicone resin; epoxy resin; urethane resin; hardening acrylic resin; alkyd resin; unsaturated polyesther resin; diarylphthalate resin; phenol resin; urea resin; benzoguanamine resin; melamine resin; a styrene polymer; an acrylic polymer; a styrene-acrylic copolymer; an olefin polymer such as polyethylene, an ethylene-vinyl acetate copolymer, chlorinated polyethylene, polypropylene, ionomer or the like; polyvinyl chloride; a vinyl chloride-vinyl acetate copolymer; polyvinyl acetate; saturated polyester; polyamide; thermoplastic urethane resin; polyarylate; polysulfon; keton resin; polyvinyl butyral; polyether; and the like.

The use of any of the above examples of the binding resin including the bisphenol-Z type polycarbonate is not limited to the specific layers (i) to (iii) mentioned above. Such binding resin may also be used for forming the other layer (upper layer) out of the multilayer type organic photosensitive layers, and an organic layer such as a surface protective layer or the like to be formed, as necessary, on the top surface of each of the photosensitive layer units of the types mentioned earlier.

The electrophotosensitive material of the present invention may be formed in the same manner as conventionally done, except for the glass transition temperature of the specific layer above-mentioned.

In the composite-type photosensitive layer unit, there may be used, as the semiconductor material forming the thin film to be used as the charge generating layer, an amorphous chalcogenide such as $\alpha$-Se, $\alpha As_2Se_3$, $\alpha$-SeAsTe or the like, and amorphous silicon ($\alpha$-Si). The charge generating layer in the form of a thin film made of the semiconductor material above-mentioned may be formed on the surface of a conductive substrate by a conventional thin-film forming method such as a vacuum evaporation method, a glow-discharge decomposition method or the like.

When the layer above-mentioned is used as the single-layer type organic photosensitive layer, or the charge transferring layer of the multilayer type or composite-type photosensitive layer unit, no particular restrictions are imposed on the charge transferring material contained in the layer. However, there may be mentioned, for example, a m-phenylenediamine compound excellent in properties for preventing a decrease in charge amount or sensitivity. This compound is represented by the following general formula [II]:

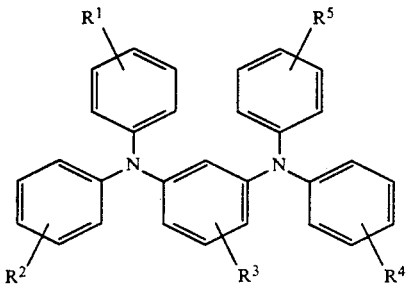

(II)

(wherein $R^1$, $R^2$, $R^3$, $R^4$and $R^5$ may be the same or different, each being selected from the group consisting of a hydrogen atom, an alkyl group, an alkoxy group and a halogen atom.)

Preferred examples of $R^1$, $R^2$, $R^3$, $R^4$and $R^5$ in the general formula [II] include a hydrogen atom, a lower alkyl group having 1 to 6 carbon atoms, a lower alkoxy group having 1 to 6 carbon atoms and a halogen atom. Examples of the lower alkyl group include a methyl group, an ethyl group, a n-propyl group, an isopropyl group, a n-butyl group, an isobutyl group, a tert-butyl group, a pentyl group and a hexyl group and the like. Examples of the lower alkoxy group include a methoxy group, an ethoxy group, a n-propoxy group, an isopropoxy group, a n-butoxy group, an isobutoxy group, a tert-butoxy group, a pentyloxy group, a hexyloxy group and the like.

Examples of the m-phenylenediamine compound include N,N,N',N'-tetraphenyl-1,3-phenylenediamine, N,N,N',N'-tetrakis(3-tolyl)-1,3-phenylenediamine, N,N,N',N'-tetraphenyl-3,5-tolylenediamine, N,N,N',N'-tetrakis(3-tolyl)-3,5-tolylenediamine, N,N,N',N'-tetrakis(4-tolyl)-1,3-phenylenediamine, N,N,N',N'-tetrakis(4-tolyl)-3,5-tolylenediamine, N,N,N',N'-tetrakis(3-ethylphenyl)-1,3-phenylenediamine, N,N,N',N'-tetrakis(4-propylphenyl)-1,3-phenylenediamine, N,N,N',N'-tetraphenyl-5-methoxy-1,3-phenylenediamine, N,N-bis(3-tolyl)-N',N'-diphenyl-1,3-phenylenediamine, N,N'-bis(4-tolyl)-N,N'-diphenyl-1,3-phenylenediamine, N,N'-bis(4-tolyl)-N,N'-bis(3-tolyl)-1,3-phenylenediamine, N,N'-bis(4-tolyl)-N,N'-bis(3-tolyl)-3,5-tolylenediamine, N,N'-bis(4-ethylphenyl)-N,N'-bis(3-ethylphenyl)-1,3-phenylenediamine, N,N'-bis(4-ethylphenyl)-N,N'-bis(3-ethylphenyl)-3,5-tolylenediamine, N,N,N',N'-tetrakis(2,4,6-trimethylphenyl)-1,3-phenylenediamine, N,N,N',N'-tetrakis(2,4,6-trimethylphenyl)-3,5-tolylenediamine, N,N,N',N'-tetrakis(3,5-dimethylphenyl)-1,3-phenylenediamine, N,N,N',N'-tetrakis(3,5-dimethylphenyl)- 3,5-tolylenediamine, N,N,N',N'-tetrakis(3,5-diethylphenyl)-1,3-phenylenediamine, N,N,N',N'-tetrakis(3,5-diethylphenyl)-3,5-tolylenediamine, N,N,N',N'-tetrakis(3-chlorophenyl)-1,3-phenylenediamine, N,N,N',N'-tetrakis(3-bromophenyl)-1,3phenylenediamine, N,N,N',N'-tetrakis(3-iodophenyl)-1,3-phenylenediamine, N,N,N',N'-tetrakis(3-fluorophenyl)-1,3-phenylenediamine and the like.

Out of the examples of the m-phenylenediamine compound above-mentioned, it is preferable to use a compound in which the groups $R^1$, $R^2$, $R^3$, $R^4$and $R^5$ in the general formula [II] are bonded to carbon atoms at the meta-positions to the bonding position of the nitrogen atom in each benzene ring; or a compound in which the group $R^1$ or $R^5$ is bonded to a carbon atom at the para-position to the bonding position of the nitrogen atom in the benzene ring and in which the group $R^2$ or $R^4$ is bonded to a carbon atom at the meta-position to the bonding position of the nitrogen atom in the benzene ring. Such a compound is hardly crystallized and is therefore readily dispersed in the binding resin for the reason of low interaction of molecules in the compound due to inferiority in symmetry of molecular structure. Examples of such a compound include N,N,N',N'-tetrakis(3-tolyl)-1,3-phenylenediamine, N,N'-bis(4-tolyl)-N,N'-bis(3-tolyl)-1,3-phenylenediamine and the like.

Generally, the layer containing the m-phenylenediamine compound preferably contains, together with the m-phenylenediamine compound, other charge transferring material which is known per se. Examples of such other charge transferring material include: tetracyanoethylene; a fluorenone compound such as 2,4,7-trinitro-9-fluorenone or the like; a fluorene compound such as 9-carbazolyliminofluorene or the like; a nitro compound such as dinitroanthracene or the like; succinic anhydride; maleic anhydride; dibromomaleic anhydride; a triphenylmethane compound; an oxadiazole compound such as 2,5-di(4-dimethylaminophenyl)-1,3,4-oxadiazole or the like; a styryl compound such as 9-(4-diethylaminostyryl)anthracene or the like; a carbazole compound such as poly N-vinylcarbazole or the like; a pyrazoline compound such as 1-phenyl-3-(p-dimethyl aminophenyl)pyrazoline or the like; an amine derivative such as 4,4',4''-toris(N,N-diphenylamino)triphenylamine, 3,3'-dimethyl-N,N,N', N'-tetrakis-4-methylphenyl(1,1'-biphenyl)-4,4'-diamine or the like; a conjugated unsaturated compound such as 1,1-bis(4-diethylaminophenyl)-4,4-diphenyl-1,3-butadiene or the like, a hydrazone compound such as 4-(N,N-diethylamino)benzaldehyde-N,N-diphenyl hydrazone or the like; a nitrogen-containing heterocyclic compound such as an indole compound, an oxazole compound, an isoxazole compound, a thiazole compound, a thiadiazole compound, an imidazole compound, a pyrazole compound, a pyrazoline compound, a triazole compound or the like; a condensed polycyclic compound; and the like. Among the above examples of the charge transferring material, a polymer having photoconductivity such as poly N-vinylcarbazole or the like may be used also as the binding resin.

No particular restrictions are imposed on the mixing ratio of other charge transferring material to the m-phenylenediamine compound. However, such a ratio by weight is preferably in a range from 95/5 to 25/75 and more preferably from 80/20 to 50/50. The ratio less than 95/5 may considerably lower the effect of preventing the decrease in charge amount, sensitivity or the like at the time when the image forming process is repeated. When the ratio is more than 25/75, the photosensitive material may not be provided with sufficient sensitivity.

No particular restrictions are imposed on the charge generating material used in the present invention. However, when forming the single-layer type photosensitive layer, it is preferable, in view of prevention of decrease in charge amount and sensitivity, to use a perylene compound represented by the following formula [III] as the charge generating material, and the m-phenylenediamine compound as the charge transferring material:

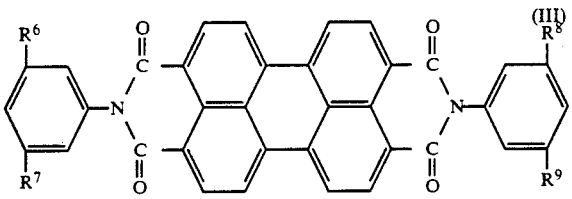

(III)

(wherein $R^6$, $R^7$, $R^8$ and $R^9$ are the same or different, alkyl group.)

As $R^6$ to $R^9$ in the perylene compound represented by the general formula [III], there may be used the alkyl group having 1 to 6 carbon atoms, of which examples include a methyl group, an ethyl group, a n-propyl group, an isopropyl group, a n-butyl group, an isobutyl group, a tert-butyl group, a pentyl group and a hexyl group.

Examples of the perylene compound include N,N'-di(3,5-dimethylphenyl)perylene-3,4,9,10-tetracarboxydiimide, N,N'-di(3-methyl-5-ethylphenyl)perylene-3,4,9,10-tetracarboxydiimide, N,N'-di(3,5-diethylphenyl)perylene-3,4,9,10-tetracarboxydiimide, N,N'-di(3,5-dinormalpropylphenyl)perylene-3,4,9,10-tetracarboxydiimide, N,N'-di(3,5-diisopropylphenyl)perylene-3,4,9,10-tetracarboxydiimide, N,N'-di(3-methyl-5-isopropylphenyl)perylene-3,4,9,10-tetracarboxydiimide, N,N'-di(3,5-dinormalbutylphenyl)perylene-3,4,9,10-tetracarboxydiimide, N,N'-di(3,5-di-tert-butylphenyl)-perylene-3,4,9,10-tetracarboxydiimide, N,N'-di(3,5-dipenthylphenyl)perylene-3,4,9,10-tetracarboxydiimide, N,N'-di(3,5-dihexylphenyl)perylene-3,4,9,10-tetracarboxydiimide and the like. Among the examples above-mentioned, N,N'-di(3,5-dimethylphenyl)perylene-3,4,9,10-tetracarboxydiimide is preferable in view of its easiness of access.

The perylene compound presents no spectro-sensitivity at the long wavelength. Accordingly, to increase the sensitivity of the photosensitive material at the time when a halogen lamp having a high red spectro-energy is combined, it is preferable to jointly use a charge generating material having sensitivity at the long wavelength of light, such as X-type metal-free phthalocyanine or the like.

A variety of examples of the X-type metal-free phthalocyanine may be used. Particularly preferable is one which presents a strong diffraction peaks at Bragg angle ($2\theta \pm 0.2°$) of 7.5°, 9.1°, 16.7°, 17.3° and 22.3°.

The mixing ratio of the X-type metal-free phthalocyanine is not limited to a certain value. However, such a mixing ratio is preferably in a range from 1.25 to 3.75 parts by weight for 100 parts by weight of the perylene compound. When the mixing ratio of the X-type metal-free phthalocyanine to 100 parts by weight of the perylene compound is less than 1.25 part by weight, this assures no sufficient improvement in sensitivity at the long wavelength. When the mixing ratio is more than 3.75 parts by weight, the spectro-sensitivity at the long wavelength of light is too high. This involves the likelihood that the reproducibility of a red color original is decreased.

Any of various examples of other charge generating materials may be used instead of or together with the perylene compound or X-type metal-free phthalocyanine. Examples of such other charge generating material include: semiconductor material powder such as $\alpha$-Se, $\alpha$-$As_2Se_3$, $\alpha$-SeAsTe or the like; a micro-crystalline of the II-VI group such as ZnO, CdS or the like; pyrylium salt; an azo compound; a bisazo compound; a phthalocyanine compound having $\alpha$-type, $\beta$-type or $\gamma$-type crystal form such as aluminium phthalocyanine, copper phthalocyanine, metal-free phthalocyanine, titanyl phthalocyanine or the like; an anthanthrone compound; an indigo compound; a triphenyl methane compound; a durene compound; a toluidine compound; a pyrazoline compound; a quinacridone compound; a pyrrolopyrrole compound and the like. These examples of the charge generating material may be used alone or in combination of plural types.

In the single-layer type organic photosensitive layer out of the photosensitive layer units of the types mentioned above, the mixing ratio of the charge generating material for 100 parts by weight of the binding resin, is preferably in a range from 2 to 20 parts by weight and more preferably from 3 to 15 parts by weight. The mixing ratio of the charge transferring material for 100 parts by weight of the binding resin, is preferably in a range from 40 to 200 parts by weight and more preferably from 50 to 100 parts by weight. If the mixing ratio of the charge generating material is less than 2 parts by weight or the mixing ratio of the charge transferring material is less than 40 parts by weight, the sensitivity of the photosensitive material may be insufficient or the residual potential may be great. On the other hand, if the mixing ratio of the charge generating material is more than 20 parts by weight or the mixing ratio of the charge transferring material is more than 200 parts by weight, the wear resistance of the photosensitive material may be insufficient.

No particular restrictions are imposed on the thickness of the single-layer type organic photosensitive layer. However, such a thickness is preferably in a range from 10 to 50 $\mu$m and more preferably from 15 to 25 $\mu$m, likewise in a conventional single-layer type organic photosensitive layer.

In the organic charge generating layer out of the layers forming the multilayer type organic photosensitive layer unit, the mixing ratio of the charge generating material for 100 parts by weight of the binding resin is preferably in a range from 5 to 500 parts by weight and more preferably from 10 to 250 parts by weight. When the mixing ratio of the charge generating material is less than 5 parts by weight, the charge generating ability may be insufficient. On the other hand, when the mixing ratio is more than 500 parts by weight, the adhesion of the charge generating layer to the substrate or adjacent other layers may be decreased.

No particular restrictions are imposed on the thickness of the charge generating layer. However, such a thickness is preferably in a range from 0.01 to 3 $\mu$m and more preferably from 0.1 to 2 $\mu$m.

In the charge transferring layer out of the layers forming the multilayer type organic photosensitive layer unit or the composite-type photosensitive layer unit, the mixing ratio of the charge transferring material for 100 parts by weight of the binding resin is preferably in a range from 10 to 500 parts by weight and more preferably from 25 to 200 parts by weight. When the mixing ratio of the charge transferring material is less than 10 parts by weight, the charge transferring ability may be insufficient. When such a mixing ratio is more than 500 parts by weight, the mechanical strength of the charge transferring layer may be lowered.

No particular restrictions are imposed on the thickness of the charge transferring layer. However, such a thickness is preferably in a range from 2 to 100 μm and more preferably from 5 to 30 μm.

The surface protective layer which may be formed on the top surface of each of the photosensitive layer units of the types mentioned earlier, is mainly composed of the binding resin above-mentioned, and may contain, as necessary, a suitable amount of an additive such as a conductivity imparting agent, a ultraviolet absorbent of the benzoquinone type, or the like.

The thickness of the surface protective layer is preferably in a range from 0.1 to 10 μm and more preferably from 2 to 5 μm.

An antioxidant may also be contained in the organic layer and the surface protective layer in each of the photosensitive layer units of the types mentioned above. The antioxidant may prevent the deterioration of the charge transferring material and the like due to the oxidation thereof.

An example of the antioxidant includes a phenol-type antioxidant such as 2,6-di-tert-butyl-p-cresol, triethyleneglycol-bis[3-(3-tert-butyl-5-methyl-4-hydroxyphenyl)propionate], 1,6-hexanediol-bis[3-(3,5-di-tert-butyl-4-hydroxyphenyl)propionate], pentaerythrityl-tetrakis[3-(3,5-di-tert-butyl-4-hydroxyphenyl)propionate], 2,2-thio-diethylenebis[3-(3,5-di-tert-butyl-4-hydroxyphenyl)propionate], 2,2-thiobis-(4-metyl-6-tert-butylphenol), N,N'-hexamethylenebis(3,5-di-tert-butyl-4-hydroxy-hydrocinnamamide), 1,3,5-trimethyl-2,4,6-tris(3,5-di-tert-butyl-4-hydroxybenzyl)benzene or the like.

Each of the photosensitive layer units of the types mentioned above is formed on the surface of a conductive substrate. The conductive substrate may be formed in a suitable shape such as a sheet, a drum or the like according to the mechanism and arrangement of an image forming apparatus in which the photosensitive material is to be incorporated.

The conductive substrate may be wholly made of a conductive material such as metal or the like. Alternately, provision may be made such that the substrate itself is made of a non-conductive structural material and conductivity is given to the surface thereof.

As the conductive material to be used for the former-type conductive substrate, there may be preferably used aluminium which is anodized (i.e. alumite or alumilite treatment) or not anodized, copper, tin, platinum, gold, silver, vanadium, molybdenum, chromium, cadmium, titanium, nickel, palladium, indium, stainless steel, brass and the like. More preferably, there may be used aluminium which has been anodized by a sulfate alumite or alumilite method and of which holes have been sealed with nickel acetate.

As examples of the latter-type conductive substrate in which conductivity is being given to the surface of the substrate itself made of a non-conductive structural material, there may be mentioned (i) one in which a thin film made of a conductive material such as any of the metals above-mentioned, aluminium iodide, tin oxide, indium oxide or the like is formed on the surface of the substrate of synthetic resin or glass by a conventional thin film forming method such as a vacuum evaporation method, a wet plating method or the like, (ii) one in which a film made of any of the metals above-mentioned is laminated cn the surface of the substrate of synthetic resin or glass, and(iii) one in which a conductivity-imparting substance is doped onto the surface of the substrate of synthetic resin or glass.

As necessary, the conductive substrate may be subjected to surface treatment with a surface treating agent such as a silane coupling agent, a titanium coupling agent or the like, thereby to enhance the adhesion of the conductive substrate to the photosensitive layer unit.

The surface protective layer and the organic layers in each of the single-layer type or multilayer type photosensitive layer units of the types mentioned above, may be formed by preparing coating solutions containing the required components, by successively applying such coating solutions onto the conductive substrate to form the layers of the lamination structures mentioned above, and by drying or hardening the coating solutions thus applied.

In preparation of the coating solutions above-mentioned, various types of a solvent may be used according to the types of binding resins and the like to be used. Examples of the solvent include: aliphatic hydrocarbon such as n-hexane, octane, cyclohexane or the like; aromatic hydrocarbon such as benzene, xylene, toluene or the like; halogenide hydrocarbon such as dichloromethane, carbon tetrachloride, chlorobenzene, methylene chloride or the like; alcohol such as methyl alcohol, ethyl alcohol, isopropyl alcohol, allyl alcohol, cyclopentanol, benzyl alcohol, furfuryl alcohol, diacetone alcohol or the like; ether such as dimethyl ether, diethyl ether, THF, ethylene glycol dimethyl ether, ethylene glycol dimethyl ether, diethylene glycol dimethyl ether or the like; ketone such as acetone, methyl ethyl ketone, methyl isobutyl ketone, cyclohexanone or the like; ester such as ethyl acetate, methyl acetate or the like; dimethyl formamide; and dimethyl sulfoxide; and the like. These examples of the solvent may be used alone or in combination of plural types. At the time of preparation of the coating solutions above-mentioned, a surface active agent, a leveling agent or the like may be jointly used to improve the dispersibility, the applicability or the like.

The coating solutions may be prepared by a conventional method with the use of, for example, a mixer, a ball mill, a paint shaker, a sand mill, an attriter, a ultrasonic dispersing device or the like.

When using THF as the solvent or dispersion medium of a coating solution to form a photosensitive layer containing the m-phenylenediamine compound as the charge transferring material, there is prepared a coating solution containing, in THF, the binding resin and the m-phenylenediamine compound as the charge transferring material, and the coating solution thus prepared is applied onto the foundation and dried or hardened. The coating solution may be applied by a conventional method such as a spray coating method, a dipping method, a flow coating method or the like.

In the photosensitive layer thus obtained, the residual THF amount should be not greater than $2.5\times10^{-3}$ μl/mg. When the amount of residual THF in the layer exceeds $2.5\times10^{-3}$ μl/mg, an excessive amount of an excited energy is transmitted from the residual THF serving as an ultraviolet absorbing substance to the m-phenylenediamine compound at the time of light irradiation. This causes a great amount of the m-phenylenediamine compound to be dimerized or decomposed. Accordingly, the photosensitive layer is considerably decreased in sensitivity at the deteriorated portion thereof. Particularly in a halftone image (grey image), a portion thereof corresponding to the deteriorated portion above-mentioned becomes darkened, resulting in lack of uniformity. It is therefore not possible to obtain an image of practical use.

To adjust the amount of residual THF in the layer to $2.5\times10^{-3}$ μl/mg or less, a variety of methods may be proposed. However, it is preferred to use a method of thermally treating the layer at 110° C. or more for 30 minutes or more in the same manner as mentioned above, so that the residual THF in the layer is vaporized and evaporated. This method requires no large-scale apparatus or the like and readily adjusts the residual THF amount to $2.5\times10^{-3}$ μl/mg or less.

If the thermally treating temperature is lower than 110° C. and the thermally treating period of time is less than 30 minutes, the amount of residual THF in the specific layer cannot be sufficiently lowered. This is why the thermally treating temperature is limited to 110° C. or more and the thermally treating period of time is limited to 30 minutes or more.

To prevent the sublimation, decomposition or the like of the functional components contained in the photosensitive layer such as the charge generating material, the charge transferring material or the like, the thermally treating temperature is preferably not higher than 130° C.

The thermal treatment under the conditions above-mentioned may be applied to the specific layer which has been already dried and hardened, or may be carried out at the same time when the specific layer is dried or hardened.

For preparing the coating solutions above-mentioned, other examples of the solvent or dispersion medium mentioned earlier may be used instead of THF.

According to the present invention, when the single-layer type photosensitive layer is obtained by preparing a coating solution containing, in THF, the binding resin, the perylene compound as the charge generating material and the m-phenylenediamine compound as the charge transferring material, by applying the solution thus prepared onto the foundation and by drying or hardening the solution thus applied, it is preferred, in view of prevention of deterioration due to visible ray, to adjust the residual THF amount in the resultant layer to $2.5\times10^{-3}$ μl/mg or less in the same manner as mentioned above.

As thus described, the glass transition temperature of the layer containing, as the binding resin, polycarbonate excellent in mechanical strength and the like, is higher than the heating temperature at the time the electrophotosensitive material is used. This produces no great difference in physical properties between the layer and the foundation to enhance the adhesion of the layer to the foundation even at the time the photosensitive material is heated for forming an image.

Further, the residual THF amount in the layer containing the m-phenylenediamine compound alone or together with the perylene compound is adjusted to $2.5\times10^{-3}$ μl/mg or less. This prevents the photosensitive material from being decreased in sensitivity even though ultraviolet rays or visible ray are irradiated, particularly at the time when the photosensitive material is heated during the operation of the image forming apparatus.

EXAMPLES

The following description will discuss in more detail the present invention with reference to Examples thereof.

EXAMPLES 1 TO 3 AND COMPARATIVE EXAMPLES 1 AND 2

Binding resin

| | |
|---|---|
| Poly-(4,4'-cyclohexylidenediphenyl)carbonate (Z-200 manufactured by Mitsubishi Gas Chemical Company, Inc. | 100 parts by weight |
| Charge generating material: | |
| N,N'-di(3,5-dimethylphenyl)perylene-3,4,9,10-tetracarboxydiimide | 5 parts by weight |
| X-type metal-free phthalocyanine (manufactured by Dainippon Ink and Chemicals, Inc.) | 0.2 part by weight |
| Charge transferring material: | |
| 3,3'-dimethyl-N,N,N'N'-tetrakis-4-methylphenyl(1,1'-biphenyl)-4,4'-diamine | 100 parts by weight |
| Antioxidant: | |
| 2,6-di-tert-butyl-p-cresol (ANTAGE BHT manufactured by Kawaguchi Kagaku Co., Ltd.) | 5 parts by weight |

Together with tetrahydrofuran, the predetermined amounts of these components were mixed and dispersed by an ultrasonic dispersing device to prepare coating solutions for single-layer type photosensitive layers. These coating solutions were applied to aluminium rolls, each having an outer diameter of 78 mm and a length of 344 mm. The rolls were dried at an ordinary temperature, and then subjected, in a dark place, to a thermal treatment under the thermal treating conditions shown in Table 1. Thus formed were drum-type electrophotosensitive materials having single-layer type photosensitive layers, each having a thickness of about 22 μm, of which glass transition temperatures are shown in Table 1. The photosensitive materials thus obtained were evaluated as to the adhesion thereof to the aluminium rolls by a checkboard-square test. The glass transition temperatures were measured by a method of differential scanning calorimetry (DSC method).

Checkboard-Square Test

With each of the electrophotosensitive materials of Examples and Comparative Examples above-mentioned set in a copying machine (Model DC-1655 manufactured by Mita Kogyo Co., Ltd.), 500 copies were taken. Then, 16 checkboard-squares of 1 mm×1 mm and 16 checkboard-squares of 5 mm×5 mm were formed on each photosensitive material with a cutter knife. A peeling test was then conducted on each photosensitive material with the use of an adhesive tape (Nichiban Tape), and the photosensitive layer was checked for peeling. There were recorded the numbers of square pieces of the respective sizes not peeled from each photosensitive material, out of the square pieces of 1 mm×1 mm and 5 mm×5 mm of each photosensitive layer. In the checkboard-square test, each photosensitive material was evaluated based on the numbers of peeled square pieces. That is, each layer in which 8 or more square pieces out of 16 square pieces of each size were peeled, was evaluated as "X", while each layer in which less than 8 square pieces were peeled, was evaluated as "0". The results are shown in Table 1.

TABLE 1

| | Thermal Treating Conditions | | Glass Transition Temp. | Checkboard-Square Test (Number of Non-peeled Square Pieces out of 16 Squares) | | |
|---|---|---|---|---|---|---|
| | Temp. (°C.) | Time (Min.) | (°C.) | 1 mm | 5 mm | Evaluation |
| Example 1 | 130 | 30 | 82.0 | 16/16 | 16/16 | ○ |
| Example 2 | 120 | 30 | 74.0 | 12/16 | 16/16 | ○ |
| Example 3 | 110 | 30 | 62.0 | 10/16 | 16/16 | ○ |
| Comparative Example 1 | 100 | 30 | 60.0 | 5/16 | 8/16 | X |
| Comparative Example 2 | 90 | 30 | 52.5 | 0/16 | 2/16 | X |

As apparent from Table 1, it was found that, as compared with Comparative Examples 1 and 2 each in which the glass transition temperature of the single-layer type photosensitive layer was lower than 62° C., the electrophotosensitive materials of Examples 1 to 3 each in which the glass transition temperature of the single-layer type photosensitive layer was not lower than 62° C., presented less peeling of the photosensitive layers according to the checkboard-square test and were therefore excellent in adhesion.

EXAMPLES 4 TO 6 AND COMPARATIVE EXAMPLES 3 AND 4

Binding resin

| | |
|---|---|
| Poly-(4,4'-cyclohexylidenediphenyl)carbonate (Z-200 manufactured by Mitsubishi Gas Chemical Company, Inc.) | 100 parts by weight |
| Charge generating material: | |
| 4,10-dibromo-dibenzo[def, mno]chrysene-6,12-dione (2,7-dibromoanthanthrone) | 5 parts by weight |
| X-type metal-free phthalocyanine (manufactured by Dainippon Ink and Chemicals, Inc.) | 0.2 part by weight |
| Charge transferring material: | |
| 3,3'-dimethyl-N,N,N'N'-tetrakis-4-methylphenyl(1,1'-biphenyl)-4,4'-diamine | 70 parts by weight |
| N,N,N',N'-tetrakis(3-tolyl)-1,3-phenylenediamine | 30 parts by weight |
| Antioxidant: | |
| 2,6-di-tert-butyl-p-cresol (ANTAGE BHT manufactured by Kawaguchi Kagaku Co., Ltd.) | 5 parts by weight |

Together with tetrahydrofuran, the predetermined amounts of these components were mixed and dispersed by an ultrasonic dispersing device to prepare coating solutions for single-layer type photosensitive layers. These coating solutions were applied to aluminium rolls, each having an outer diameter of 78 mm and a length of 344 mm. The rolls were dried at an ordinary temperature, and then subjected, in a dark place, to a thermal treatment under the thermal treating conditions shown in Table 2. Thus formed were drum-type electrophotosensitive materials having single-layer type photosensitive layers, each having a thickness of about 22 μm, of which glass transition temperatures are shown in Table 2. The glass transition temperatures were measured by a method of differential scanning calorimetry (DSC method).

The following tests were conducted on the electrophotosensitive materials of Examples 4 to 6 and Comparative Examples 3 and 4.

Measurement of Initial Surface Potential

Each electrophotosensitive material was set in an electrostatic test copier (Gentec Cynthia 30M manufactured by Gentec Co.). With the surface of each electrophotosensitive material positively charged, the surface potential $V_1$ s.p.(V) was measured.

Measurement of Half-Life Light Exposure and Residual Potential

Each electrophotosensitive material thus charged was exposed to a halogen lamp serving as the exposure light source of aforementioned electrostatic test copier. The time during which the surface potential $V_1$ s.p.(V) is reduced to a half, was then determined, and the half-life light exposure E ½ (μJ/cm²) was calculated.

Further, the surface potential after the passage of 0.19 second after the light exposure above-mentioned had started, was measured as a residual potential $V_1$ r.p.(V).

Measurement of Variations of Residual Potential and Surface Potential After Irradiation of Ultraviolet Rays At two points on the surface of each electrophotosensitive material, the surface potentials $V_{1a}$ s.p., $V_{1b}$ s.p. and the residual potentials $V_{1a}$ r.p., $V_{1b}$ r.p. were measured in the same manner as in Tests above-mentioned. Each electrophotosensitive material was preheated in a dark place at 60° C. for 20 minutes. With one point at the $V_{1b}$ side of the two points above-mentioned masked with a light shield material and each electrophotosensitive material kept warm at 60° C., the surface of each electrophotosensitive material was exposed, for 20 minutes, to white light of 1500 lux. containing ultraviolet rays with the use of a white fluorescent lamp (NATIONAL HIGH-LIGHT FL of 15 W). Each electrophotosensitive material after exposed to the white light containing ultraviolet rays, was left in a dark place at an ordinary temperature for 30 minutes, and then cooled. Each electrophotosensitive material was set in an electrostatic test copier (Gentec Cynthia 30M manufactured by Gentec Co.). With the surface positively charged, there were measured the surface potentials $V_{2a}$ s.p. (light exposure side), $V_{2b}$ s.p. (light shielded side), and the residual potentials $V_{2a}$ r.p. (light exposure side), $V_{2b}$ r.p. (light shielded side).

With the use of the measured values thus obtained, a variation of the surface potential ΔV s.p.(V) after irradiation of ultraviolet rays, was calculated with the use of the following equation (a), and a variation of the residual potential ΔV r.p.(V) after irradiation of ultraviolet rays, was calculated with the use of the following equation (b).

$$\Delta V\,s.p. = (V_{2a}\,s.p. - V_{1a}\,s.p.) - (V_{2b}\,s.p. - V_{1b}\,s.p.) \quad (a)$$

$$\Delta V\,r.p. = (V_{2a}\,r.p. - V_{1a}\,r.p.) - (V_{2b}\,r.p. - V_{1b}\,r.p.) \quad (b)$$

Practice Test

Each electrophotosensitive material after exposed to ultraviolet rays was set in a copying machine (DC-1655 manufactured by Mita Kogyo Co., Ltd.), and a half-tone document was copied. The obtained images were visually checked for the evenness of density. The images containing no uneven density were evaluated by "0", while the images containing uneven density were evaluated by "X". Test results are shown in Table 2.

TABLE 2

| | Thermal Treating Conditions | | Glass Transition Temp. (°C.) | Test Results | | | | | |
|---|---|---|---|---|---|---|---|---|---|
| | Temp. (°C.) | Time (Min.) | | $V_1$ s.p. (V) | E ½ (μJ/cm²) | $V_1$ r.p. (V) | ΔV s.p. (V) | ΔV r.p. (V) | Image |
| Example 4 | 130 | 30 | 80 | 715 | 5.43 | 160 | 0 | 0 | ○ |
| Example 5 | 120 | 30 | 71 | 720 | 5.50 | 165 | 5 | +10 | ○ |
| Example 6 | 110 | 30 | 62 | 715 | 5.91 | 179 | 20 | +20 | ○ |
| Comparative Example 3 | 100 | 30 | 57 | 718 | 6.31 | 190 | 50 | +38 | X |
| Comparative Example 4 | 90 | 30 | 50 | 712 | 7.40 | 230 | 100 | +55 | X |

As apparent from Table 2, it was found that, as compared with Comparative Examples 3 and 4 each in which the glass transition temperature of the single-layer type photosensitive layer was lower than 62° C., the electrophotosensitive materials of Examples 4 to 6 each in which the glass transition temperature of the single-layer type photosensitive layer was not lower than 62° C., presented a smaller variation of surface potential of not greater than 20 V and a smaller variation of residual potential of not greater than 20 V due to irradiation of ultraviolet rays. It is therefore understood that the electrophotosensitive materials of Examples 4 to 6 are hardly deteriorated due to ultraviolet rays.

EXAMPLES 7 TO 9 AND COMPARATIVE EXAMPLES 5 AND 6

Binding resin

| | |
|---|---|
| Poly-(4,4'-cyclohexylidenediphenyl)carbonate (Z-200 manufactured by Mitsubishi Gas Chemical Company, Inc.) | 100 parts by weight |
| Charge generating material: | |
| N,N'-di(3,5-dimethylphenyl)perylene-3,4,9,10-tetracarboxydiimide | 5 parts by weight |
| X-type metal-free phthalocyanine (manufactured by Dainippon Ink and Chemicals, Inc.) | 0.2 part by weight |
| Charge transferring material: | |
| 3,3'-dimethyl-N,N,N'N'-tetrakis-4-methylphenyl(1,1'-biphenyl)-4,4'-diamine | 70 parts by weight |
| N,N,N',N'-tetrakis(3-tolyl)-1,3-phenylenediamine | 30 parts by weight |
| Antioxidant: | |
| 2,6-di-tert-butyl-p-cresol (ANTAGE BHT manufactured by Kawaguchi Kagaku Co., Ltd.) | 5 parts by weight |

Together with tetrahydrofuran, the predetermined amounts of these components were mixed and dispersed by an ultrasonic dispersing device to prepare coating solutions for single-layer type photosensitive layers. These coating solutions were applied to aluminium rolls, each having an outer diameter of 78 mm and a length of 344 mm. The rolls were dried at an ordinary temperature, and then subjected, in a dark place, to a thermal treatment under the thermal treating conditions shown in Table 3. Thus formed were drum-type electrophotosensitive materials having single-layer type photosensitive layers, each having a thickness of about 22 μm, of which glass transition temperatures are shown in Table 3. The glass transition temperatures were measured by a method of differential scanning calorimetry (DSC method).

In the same manners as in Examples 4 to 6, tests were conducted on the electrophotosensitive materials of Examples 7 to 9 and Comparative Examples 5 and 6 to measure their initial surface potentials, half-life light exposures and residual potentials. Further, the variations of residual potentials and the variations of surface potentials after irradiation of ultraviolet rays of these electrophotosensitive materials were measured in the same manner as in Examples 4 to 6, except that the electrophotosensitive materials were exposed to yellow light of 1500 lux with the use of a yellow fluorescent lamp (NATIONAL COLORED FLUORESCENT LAMP FL20SYF of 20 W), instead of the white fluorescent lamp used in the tests for Examples 4 to 6. Also, a practice test was conducted in the same manner as in Examples 4 to 6. The test results are shown in Table 3.

TABLE 3

| | Thermal Treating Conditions | | Glass Transition Temp. (°C.) | Test Results | | | | | |
|---|---|---|---|---|---|---|---|---|---|
| | Temp. (°C.) | Time (Min.) | | $V_1$ s.p. (V) | E ½ (μJ/cm²) | $V_1$ r.p. (V) | ΔV s.p. (V) | ΔV r.p. (V) | Image |
| Example 7 | 130 | 30 | 80 | 713 | 5.49 | 152 | 0 | 0 | ○ |
| Example 8 | 120 | 30 | 71 | 717 | 5.43 | 152 | 5 | +10 | ○ |
| Example 9 | 110 | 30 | 62 | 727 | 5.91 | 178 | 20 | +20 | ○ |
| Comparative Example 5 | 100 | 30 | 57 | 720 | 6.20 | 190 | 50 | +41 | X |
| Comparative | 90 | 30 | 50 | 705 | 7.50 | 240 | 100 | +58 | X |

TABLE 3-continued

| | Thermal Treating Conditions | | Glass Transition Temp. | Test Results | | | | | |
|---|---|---|---|---|---|---|---|---|---|
| | Temp. (°C.) | Time (Min.) | (°C.) | $V_1$ s.p. (V) | $E\frac{1}{2}$ ($\mu J/cm^2$) | $V_1$ r.p. (V) | ΔV s.p. (V) | ΔV r.p. (V) | Image |
| Example 6 | | | | | | | | | |

As apparent from Table 3, it was found that, as compared with Comparative Examples 5 and 6 each in which the glass transition temperature of the single-layer type photosensitive layer was lower than 62° C., the electrophotosensitive materials of Examples 7 to 9 each in which the glass transition temperature of the single-layer type photosensitive layer was not lower than 62° C., presented a smaller variation of surface potential of not greater than 20 V and a smaller variation of residual potential of not greater than 20 V due to irradiation of visible ray. It is therefore understood that the electrophotosensitive materials of Examples 7 to 9 are hardly deteriorated due to visible ray.

EXAMPLE 10 (INVESTIGATION OF THERMAL TREATING CONDITIONS)

(1) Relationship between thermal treating temperature and residual THF amount

Binding resin

| | |
|---|---|
| Poly-(4,4'-cyclohexylidenediphenyl)carbonate (Z-200 manufactured by Mitsubishi Gas Chemical Company, Inc.) | 100 parts by weight |
| Charge generating material: | |
| 4,10-dibromo-dibenzo[def, mno]chrysene-6,12-dione (2,7-dibromoanthanthrone) | 5 parts by weight |
| X-type metal-free phthalocyanine (manufactured by Dainippon Ink and Chemicals, Inc.) | 0.2 part by weight |
| Charge transferring material: | |
| 3,3'-dimethyl-N,N,N'N'-tetrakis-4-methylphenyl(1,1'-biphenyl)-4,4'-diamine | 70 parts by weight |
| N,N,N',N'-tetrakis(3-tolyl)-1,3-phenylenediamine | 30 parts by weight |
| Antioxidant: | |
| 2,6-di-tert-butyl-p-cresol (ANTAGE BHT manufactured by Kawaguchi Kagaku Co., Ltd.) | 5 parts by weight |

Together with THF, the predetermined amounts of these components were mixed and dispersed by an ultrasonic dispersing device to prepare a coating solution for a single-layer type photosensitive layer. The coating solution was applied to an aluminium roll having an outer diameter of 78 mm and a length of 344 mm. The roll was dried at an ordinary temperature, and then subjected, in a dark place, to a thermal treatment under the thermal treating conditions shown in Table 1. Thus formed was a drum-type electrophotosensitive material having a single-layer type photosensitive layer with a thickness of about 22 μm. The amount of residual THF in the single-layer type photosensitive layer of the electrophotosensitive material was measured by a pyrolysis gas chromatography. The results are shown in FIG. 1.

It was found from FIG. 1 that, when the heating temperature was set to 110° C. or more, the amount of residual THF in the layer could be adjusted to $2.5\times10^{-3}$ μl/mg or less.

(2) Relationship between thermal heating period of time and residual THF amount

A coating solution identical with that above-mentioned was applied to an aluminium roll having an outer diameter of 78 mm and a length of 344 mm. The roll was dried at an ordinary temperature, and then subjected, in a dark place, to a thermal treatment at a temperature of 110° C. for the period of time shown in FIG. 2. Thus formed was a drum-type electrophotosensitive material having a single-layer type photosensitive layer with a thickness of about 22 μm. The amount of residual THF in the single-layer type photosensitive layer of the electrophotosensitive material was measured by a pyrolysis gas chromatography. The results are shown in FIG. 2.

Figure 2:
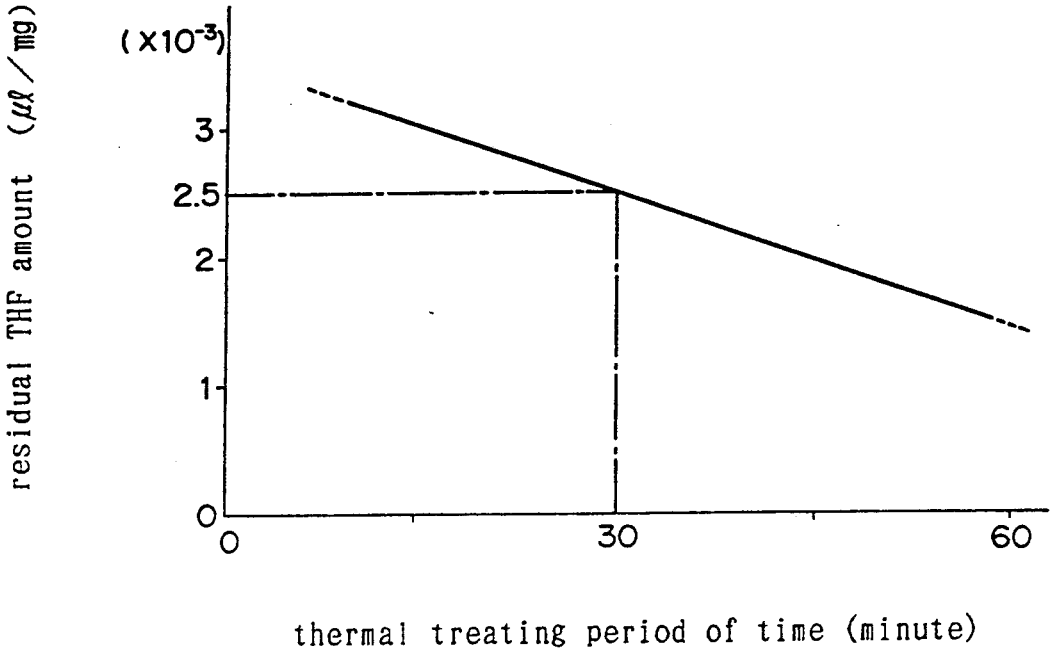
FIG. 2 is a graph showing the relationship between thermal treating period of time and residual THF amount of a single-layer type photosensitive layer.

It was found from FIG. 2 that, when the heating period of time was set to 30 minutes or more, the amount of residual THF in the layer could be adjusted to $2.5\times10^{-3}$ μl/mg or less.

(3) Relationship between layer thickness and residual THF amount

Figure 3:
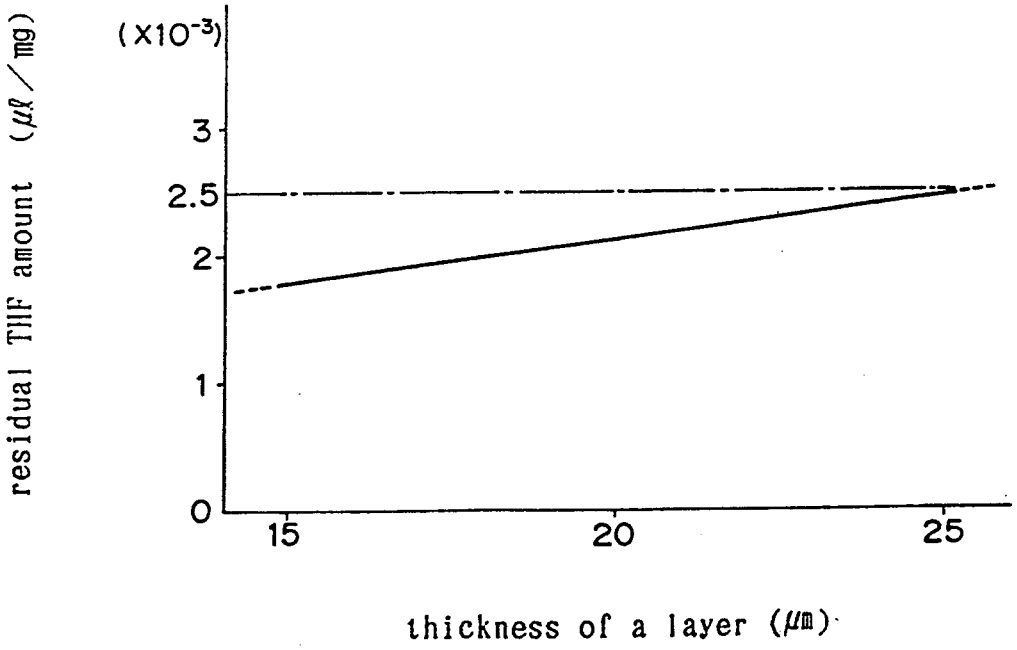
FIG. 3 is a graph showing the relationship between thickness and residual THF amount after thermal treatment of a single-layer type photosensitive layer.

A coating solution identical with that above-mentioned was applied to an aluminium roll having an outer diameter of 78 mm and a length of 344 mm so that the thickness of the photosensitive layer after thermal treatment was the same as that shown in FIG. 3. The roll was dried at an ordinary temperature, and then subjected, in a dark place, to a thermal treatment at a temperature of 110° C. for 30 minutes to prepare a single-layer type photosensitive layer. Then, a drum-type electrophotosensitive material was formed. The amount of residual THF in the single-layer type photosensitive layer of the electrophotosensitive material was measured by a pyrolysis gas chromatography method. The results are shown in FIG. 3.

It was found from FIG. 3 that, when the thermal treatment at 110° C. for 30 minutes was carried out on the photosensitive layer, the amount of residual THF therein could be adjusted to $2.5\times10^{-3}$ μl/mg or less, regardless of the thickness of the photosensitive layer, as far as the thickness thereof was in a normal range from 15 to 22 μm for the single-layer type photosensitive layer.

EXAMPLES 11 TO 13 AND COMPARATIVE EXAMPLES 7 AND 8

Coating solutions for single-layer type photosensitive layers, each identical with that prepared in Example 10-(1), were applied to aluminium rolls each having an outer diameter of 78 mm and a length of 344 mm. The rolls were dried at an ordinary temperature, and then subjected, in a dark place, to a thermal treatment under the thermal treating conditions shown in Table 4. Thus formed were drum-type electrophotosensitive materials, each having a single-layer type photosensitive layer having a thickness of about 22 μm, of which residual THF amounts in the layers are shown in Table 4.

In the same manners as in Examples 4 to 6, tests of measurements of initial surface potential, half-life light exposure amount, residual potential and variations of surface potential and residual potential after irradiation of visible ray, and a practice test were conducted on the electrophotosensitive materials of Examples 11 to 13 and Comparative Examples 7 and 8. The test results are shown in Table 4.

TABLE 4

| | Thermal Treating Conditions | | Residual | Test Results | | | | | |
|---|---|---|---|---|---|---|---|---|---|
| | Temp. (°C.) | Time (Min.) | THF Amount (μl/mg) | $V_1$ s.p. (V) | $E_{\frac{1}{2}}$ (μJ/cm²) | $V_1$ r.p. (V) | ΔV s.p. (V) | ΔV r.p. (V) | Image |
| Example 11 | 130 | 30 | 0 | 715 | 5.43 | 160 | 0 | 0 | ○ |
| Example 12 | 120 | 30 | $1.0 \times 10^{-3}$ | 720 | 5.50 | 165 | 5 | +12 | ○ |
| Example 13 | 110 | 30 | $2.5 \times 10^{-3}$ | 715 | 5.91 | 179 | 20 | +20 | ○ |
| Comparative Example 7 | 100 | 30 | $5.0 \times 10^{-3}$ | 720 | 6.34 | 189 | 50 | +45 | X |
| Comparative Example 8 | 90 | 30 | $8.0 \times 10^{-3}$ | 710 | 7.42 | 229 | 100 | +60 | X |

As apparent from Table 4, it was found that, as compared with Comparative Examples 7 and 8 each in which the amount of residual THF in the single-layer type photosensitive layer exceeded $2.5 \times 10^{-3}$ μl/mg, the electrophotosensitive materials of Examples 11 to 13 each in which the amount of residual THF in the single-layer type photosensitive layer was not greater than $2.5 \times 10^{-3}$ μl/mg, presented a smaller variation of surface potential of not greater than 20 V and a smaller variation of residual potential of not greater than 20 V due to irradiation of ultraviolet rays. It is therefore understood that the electrophotosensitive materials of Examples 11 to 13 are hardly deteriorated due to ultraviolet rays.

EXAMPLE 14 (INVESTIGATION OF THERMAL TREATING CONDITIONS)

The thermal treating conditions were investigated in the same manner as in Example 10, except that N,N'-di(3,5-dimethylphenyl)perylene-3,4,9,10-tetracarboxydiimide was used as the charge generating material instead of 4,10-dibromo-dibenzo[def, mno]chrysene-6,12-dione (2,7-dibromoanthanthrone) used in Example 10. It was found that results similar to those shown in FIGS. 1 to 3 were obtained with the single-layer type photosensitive layer containing a m-phenylenediamine compound and a perylene compound.

EXAMPLE 15 TO 17 AND COMPARATIVE EXAMPLES 9 AND 10

Coating solutions for single-layer type photosensitive layers, each identical with that prepared in Example 14, were applied to aluminium rolls each having an outer diameter of 78 mm and a length of 344 mm. The rolls were dried at an ordinary temperature, and then subjected, in a dark place, to a thermal treatment under the thermal treating conditions shown in Table 5. Thus formed were drum-type electrophotosensitive materials, each having a single-layer type photosensitive layer having a thickness of about 22 μm, of which residual THF amounts in the layers are shown in Table 5.

In the same manners as in Examples 7 to 9, tests of measurements of initial surface potential, half-life light exposure amount, residual potential and variations of surface potential and residual potential after irradiation of visible ray, and a practice test were conducted on the electrophotosensitive materials of Examples 15 to 17 and Comparative Examples 9 and 10. The test results are shown in Table 5.

TABLE 5

| | Thermal Treating Conditions | | Residual | Test Results | | | | | |
|---|---|---|---|---|---|---|---|---|---|
| | Temp. (°C.) | Time (Min.) | THF Amount (μl/mg) | $V_1$ s.p. (V) | $E_{\frac{1}{2}}$ (μJ/cm²) | $V_1$ r.p. (V) | ΔV s.p. (V) | ΔV r.p. (V) | Image |
| Example 15 | 130 | 30 | 0 | 713 | 5.49 | 152 | 0 | 0 | ○ |
| Example 16 | 120 | 30 | $1.0 \times 10^{-3}$ | 717 | 5.43 | 152 | 5 | +12 | ○ |
| Example 17 | 110 | 30 | $2.5 \times 10^{-3}$ | 727 | 5.91 | 178 | 20 | +20 | ○ |
| Comparative Example 9 | 100 | 30 | $5.0 \times 10^{-3}$ | 727 | 6.16 | 186 | 50 | +40 | X |
| Comparative Example 10 | 90 | 30 | $8.0 \times 10^{-3}$ | 701 | 7.45 | 234 | 100 | +58 | X |

As apparent from Table 5, it was found that, as compared with Comparative Examples 9 and 10 each in which the amount of residual THF in the single-layer type photosensitive layer exceeded $2.5 \times 10^{-3}$ μl/mg, the electrophotosensitive materials of Examples 15 to 17 each in which the amount of residual THF in the single-layer type photosensitive layer was not greater than $2.5 \times 10^{-3}$ μl/mg, presented a smaller variation of surface potential of not greater than 20 V and a smaller variation of residual potential of not greater than 20 V due to irradiation of visible ray. It is therefore understood that the electrophotosensitive materials of Examples 15 to 17 are hardly deteriorated due to visible ray.

We claim:

1. An electrophotosensitive material having a single-layer type photosensitive layer formed on the surface of a conductive substrate, wherein the photosensitive layer includes a charge generating material a polycarbonate resin as a binding resin, said polycarbonate resin being represented by the following formula (I):

(I)

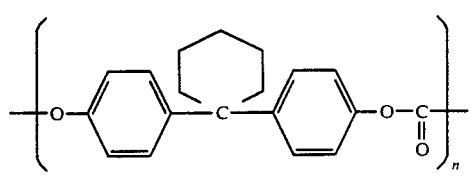

and an m-phenylenediamine compound as a charge transferring material represented by the following formula (II):

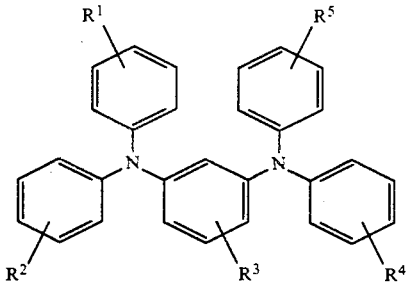

(II)

wherein $R^1$, $R^2$, $R^3$, $R^4$ and $R^5$ may be the same or different, each being a hydrogen atom, an alkyl group, an alkoxy group or a halogen atom, said photosensitive layer having a glass transition temperature of not lower than 62° C.

2. An electrophotosensitive material according to claim 1, wherein the photosensitive layer includes a perylene compound as the charge generating material..

3. A method of manufacturing an electrophotosensitive material, said electrophotosensitive material being a single-layer type photosensitive layer formed on the surface of a conductive substrate, wherein the photosensitive layer a charge generating material includes a polycarbonate resin as a binding resin, said polycarbonate resin being represented by the following formula (I):

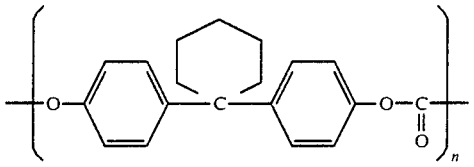

(I)

and an m-phenylenediamine compound as a charge transferring material represented by the following formula (II):

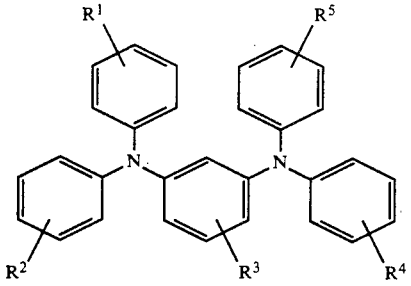

(II)

wherein $R^1$, $R^2$, $R^3$, $R^4$ and $R^5$ may be the same or different, each being a hydrogen atom, an alkyl group, an alkoxy group or a halogen atom, said method comprising the step of thermally treating the photosensitive layer containing polycarbonate as a binding resin, at a temperature not lower than 110° C. for 30 minutes or more such that the glass transition temperature of said photosensitive layer is adjusted to not lower than 62° C.

4. An electrophotosensitive material according to claim 1, wherein the photosensitive layer includes a perylene compound as the charge generating material in an amount of 2 to 20 parts by weight per 100 parts by weight of the polycarbonate resin.

5. An electrophotosensitive material according to claim 1, wherein the m-phenylenediamine compound represented by formula (II) is includes in an amount of 40 to 200 parts by weight per 100 parts by weight of the polycarbonate resin.

6. An electrophotosensitive material having a single-layer type photosensitive layer formed on the surface of a conductive substrate, wherein the photosensitive layer includes a charge generating material a polycarbonate resin represented by the following formula (I):

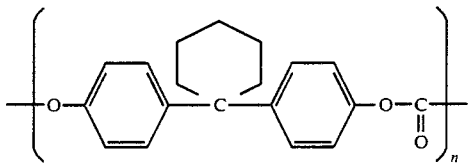

(I)

an m-phenylenediamine compound represented by the following formula (II):

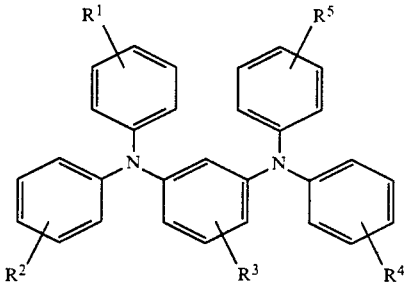

(II)

wherein $R^1$, $R^2$, $R^3$, $R^4$ and $R^5$ may be the same or different, each being a hydrogen atom, an alkyl group, an alkoxy group or a halogen atom;

and tetrahydrofuran, wherein an amount of residual tetrahydrofuran in said photosensitive layer being not greater than $2.5\times10^{-3}$ μl/mg.

7. A method of manufacturing an electrophotosensitive material, said electrophotosensitive material being a single-layer type photosensitive layer formed on the surface of a conductive substrate, wherein the photosensitive layer a charge generating material includes a polycarbonate resin represented by the following formula (I):

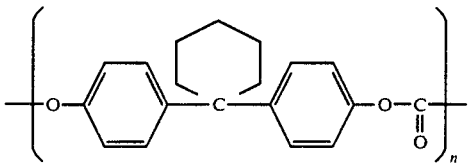

(I)

an m-phenylenediamine compound represented by the following formula (II):

(II)

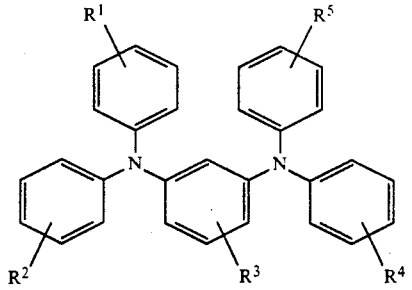

wherein $R^1$, $R^2$, $R^3$, $R^4$ and $R^5$ may be the same or different, each being a hydrogen atom, an alkyl group, an alkoxy group or a halogen atom, and tetrahydrofuran, wherein an amount of residual tetrahydrofuran in said photosensitive layer being not greater than $2.5\times10^{-3}$ μl/mg, said method comprising the step of thermally treating the photosensitive layer containing polycarbonate at a temperature not lower than 110° C. for 30 minutes or more.

* * * * *